United States Patent [19]

Mitchell et al.

[11] 3,977,664

[45] Aug. 31, 1976

[54] HYDRAULIC CONTROL VALVE ARRANGEMENT FOR OPERATING TABLES AND THE LIKE

[75] Inventors: Larry D. Mitchell, Ballwin; Edward M. Mason, St. Louis, both of Mo.

[73] Assignee: Affiliated Hospital Products, Inc., St. Louis, Mo.

[22] Filed: Mar. 25, 1975

[21] Appl. No.: 561,887

[52] U.S. Cl. ..... 269/325

[51] Int. Cl.[2] ..... A61G 13/00

[58] Field of Search ..... 269/322–325; 5/63, 66–69

[56] References Cited

UNITED STATES PATENTS

| | | | |
|---|---|---|---|
| 3,206,188 | 9/1965 | Douglass et al. | 269/325 |
| 3,845,946 | 11/1974 | Warden et al. | 269/323 |
| 3,868,103 | 2/1975 | Pageot et al. | 269/325 |
| 3,896,704 | 7/1975 | Barud et al. | 269/325 |

*Primary Examiner*—Al Lawrence Smith
*Assistant Examiner*—Robert C. Watson

[57] ABSTRACT

A hydraulic control valve arrangement for operating tables or the like, in which the table has both table top function control valves and associated hydraulic movement actuation cylinders and an elevate function valve and associated hydraulic elevation cylinder, and in which the elevate function control valve is operated by a separate control lever and is in overriding control of fluid supply pressure to the separate control lever-actuated table top function control valves, whereby either the elevate cylinder or a table top function actuation cylinder may be individually operated at one time, but not both the elevate cylinder and a table top function control cylinder, and whereby it is not necessary to switch a single control lever back and forth between elevate position and a selected table top function control position in order to selectively alternately effect elevation adjustment and a given selected table top function adjustment of the table top for desired table top positioning. A pilot-operated cylinder lock valve and pressure-compensated valve arrangement is provided in flow control to and from each hydraulic cylinder or cylinders actuating arrangement to prevent external load-induced movement of the cylinders and associate table top section or sections and to smooth out flow and table top movement when abrupt supply and/or external load-induced hydraulic pressure variations occur.

34 Claims, 12 Drawing Figures

HYDRAULIC CONTROL VALVE ARRANGEMENT FOR OPERATING TABLES AND THE LIKE

This invention relates to a hydraulic control arrangement for operating tables or the like, in which elevate and table top function controls are operated by separate actuator handles or levers, and in which the elevate control valve also controls the flow of liquid through the table top function valves.

It is desirable to provide a hydraulically actuated operating table which will enable an operator to adjust the table top to a desired Trendelenberg, laterally tilted, flexed and/or other configuration or position while also enabling alternate but separate elevation control and without requiring movement of a control lever back and forth between elevate and the desired table top function control position.

It is also desirable that supply and/or external load-induced hydraulic pressure variations will not be reflected in abrupt table top articulation movement or cessation of movement.

It is accordingly a feature of the present invention to provide a hydraulic control valve arrangement for an operating table or the like, in which the elevate function control valve is operated by a separate control lever or handle and is arranged in overriding valved control of fluid flow through the various separate control lever-actuated table top function control valves and associated table top function actuation cylinders, whereby either the elevate cylinder or a table top function cylinder may be individually operated at a given time, and whereby it is not necessary to move a common control lever back and forth between elevate and the desired table top function control position.

It is a further feature of the present invention to provide an operating table or the like which is hydraulically actuated, and will enable an operator to adjust a table top to a desired articulated configuration or position, while also enabling alternate but separate elevation control and without requiring movement of a control lever back and forth between elevate and desired table top function control position.

It is still a further feature to provide such an operating table in which supply and/or external lead induced hydraulic pressure variations, such as may result from the alternate elevation and table top function control valve actuation, or shifting of patient load, will not be reflected in abrupt table top articulation movement or cessation of movement.

Still other objects, features, and attendant advantages will become apparent to one skilled in the art from a reading of the detailed description of a preferred embodiment constructed in accordance with the invention, taken in conjunction with the accompanying drawings, wherein.

Figure 1:
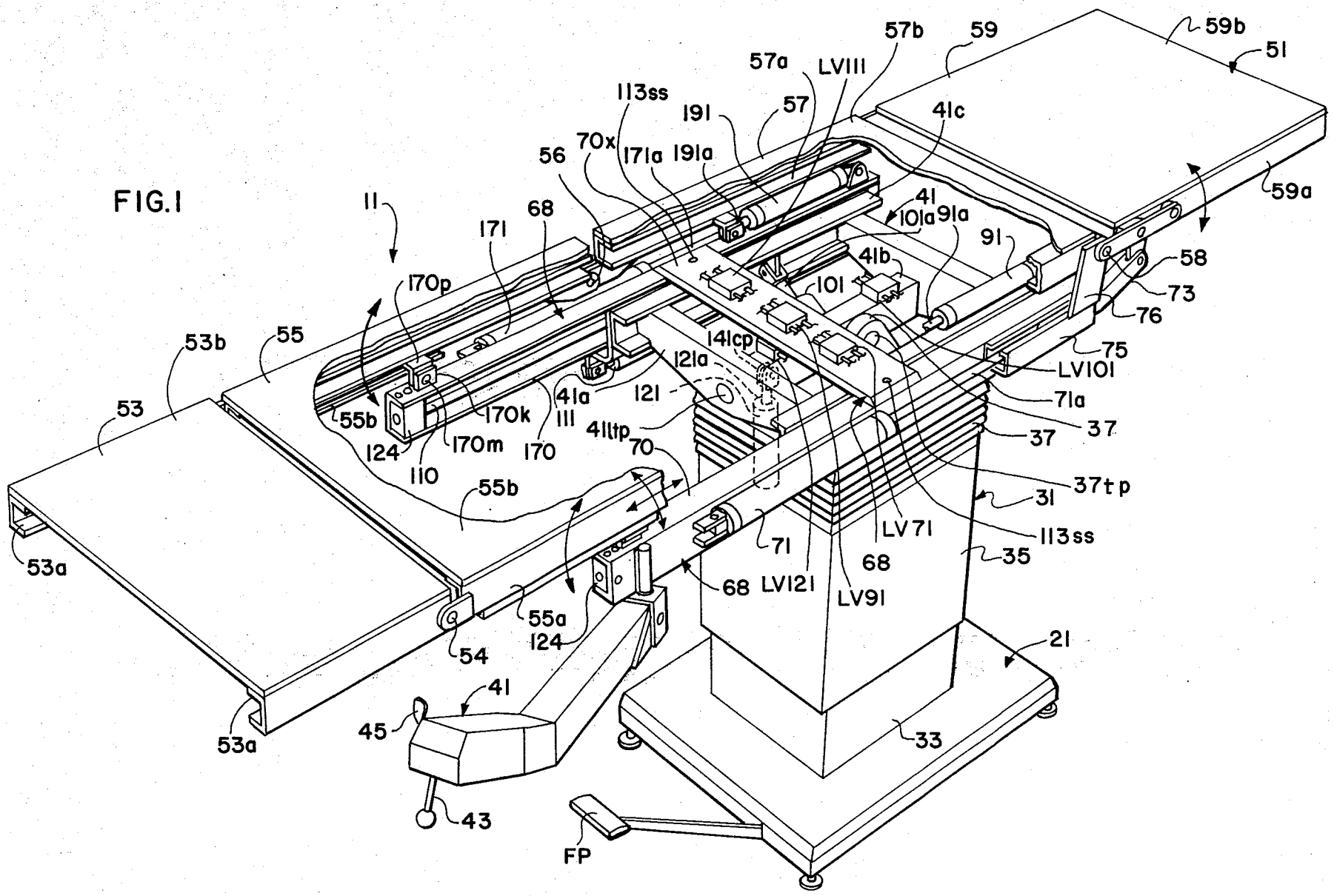
FIG. 1 is a perspective view of an operating table in which the invention is utilized to advantage, the table being partially cut away as an aid to clarity and ease of description and understanding.

FIGS. 4A–4D are simplified schematic illustrations of the hydraulic control valve arrangement of the invention, as applied to a single hydraulic actuating cylinder and the elevate cylinder of the table top of FIG. 1, showing the various modes of respectively neutral, articulated actuation cylinder in one direction, articulated actuation cylinder in the opposite direction, and elevation cylinder raising operation.

Figure 2:
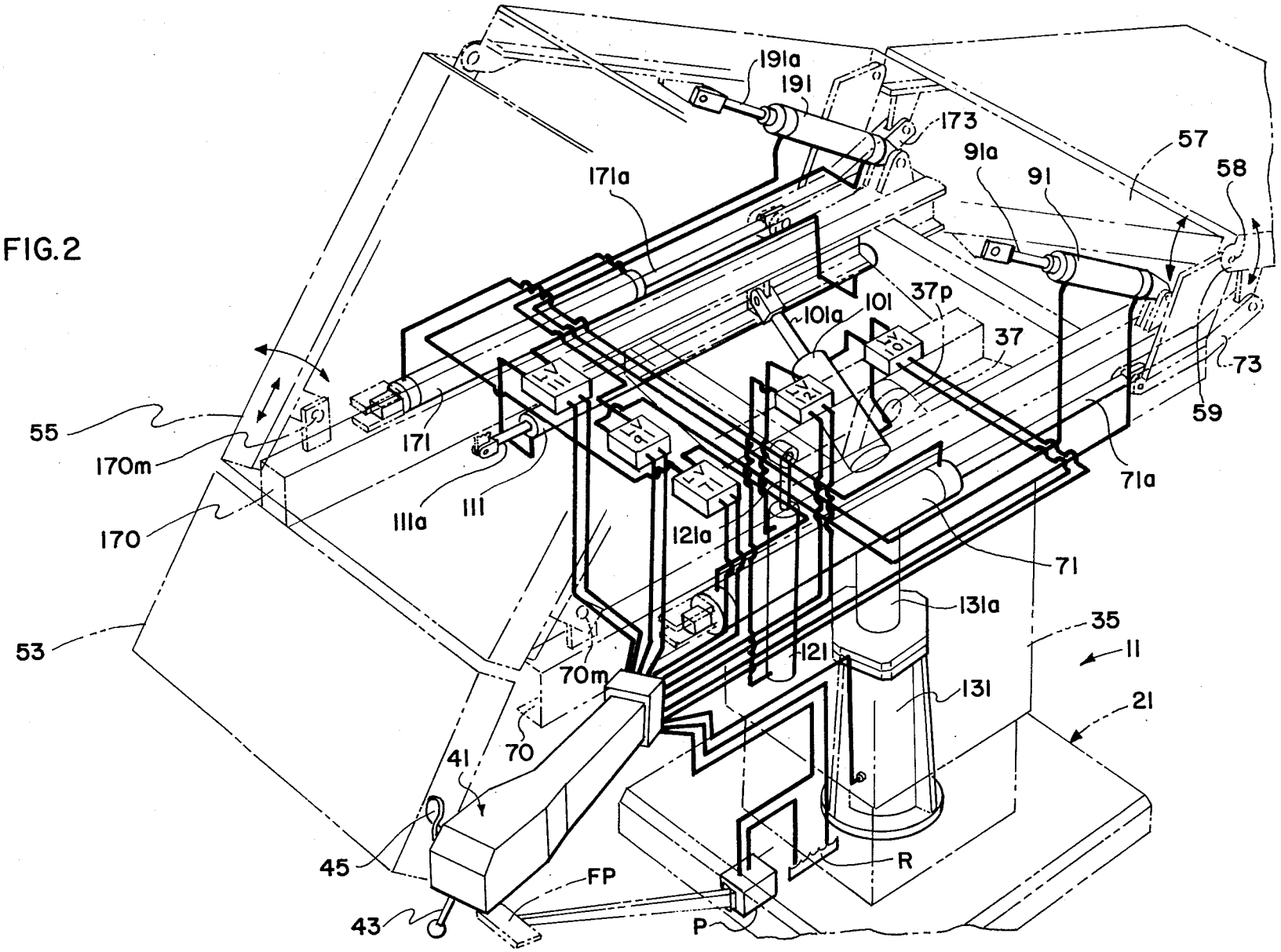
FIG. 2 is a schematic illustration of the application of the invention to the operating table of FIG. 1, the major structure of the operating table being shown in phantom, with the hydraulic circuitry shown in exaggerated solid lines for ease and clarity of illustration.
Figure 5A:
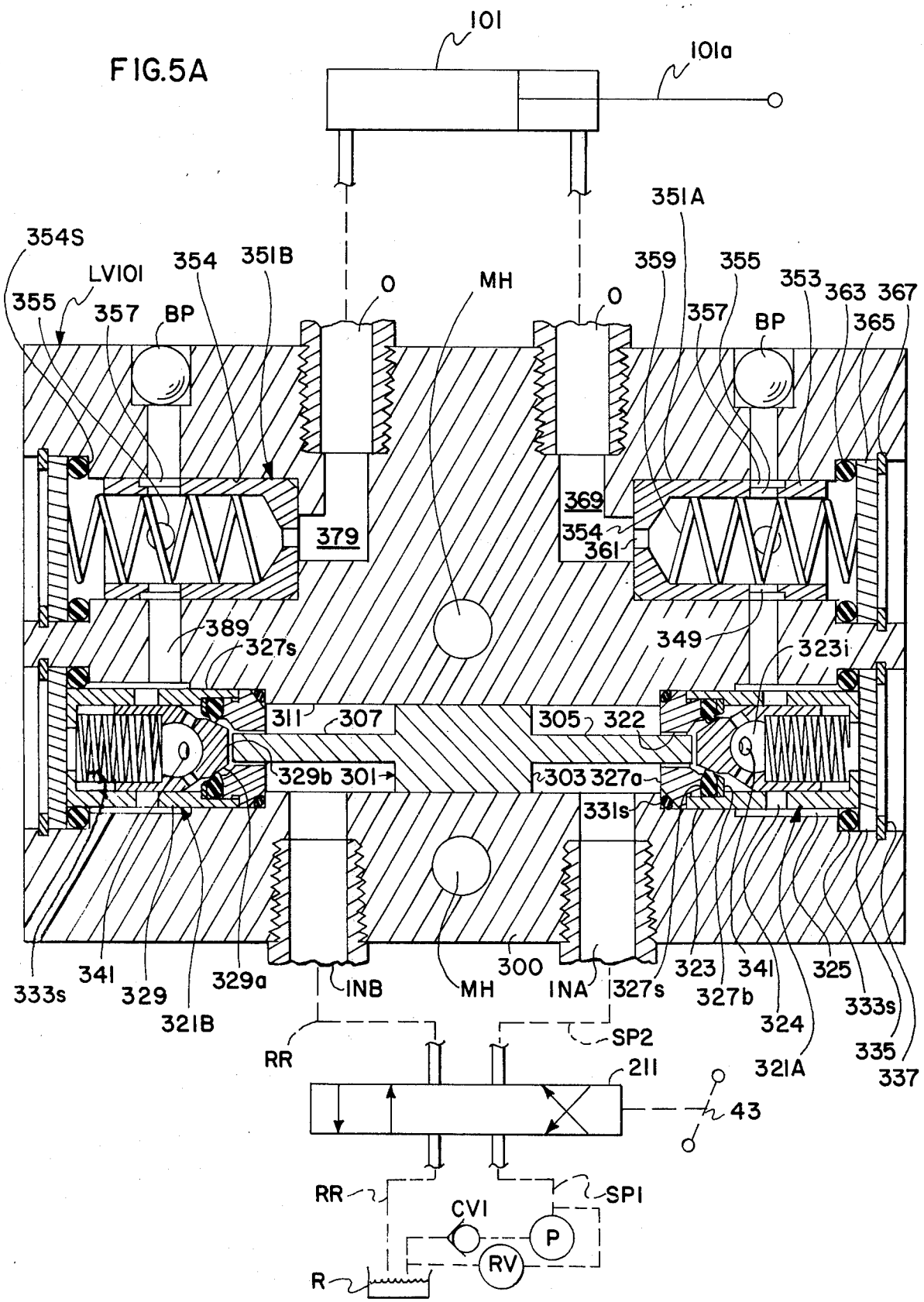

FIG. 5A is an illustration, partly in section and partly schematic, illustration the pilot-operated cylinder lock valve and pressure-compensated flow control valve arrangement embodied in the preferred utilization or application of the invention, as employed in the operating table of FIGS. 1 and 2, the apparatus being shown in the condition of zero fluid supply pressure to the cylinder lock valve arrangement.

Figure 5B:
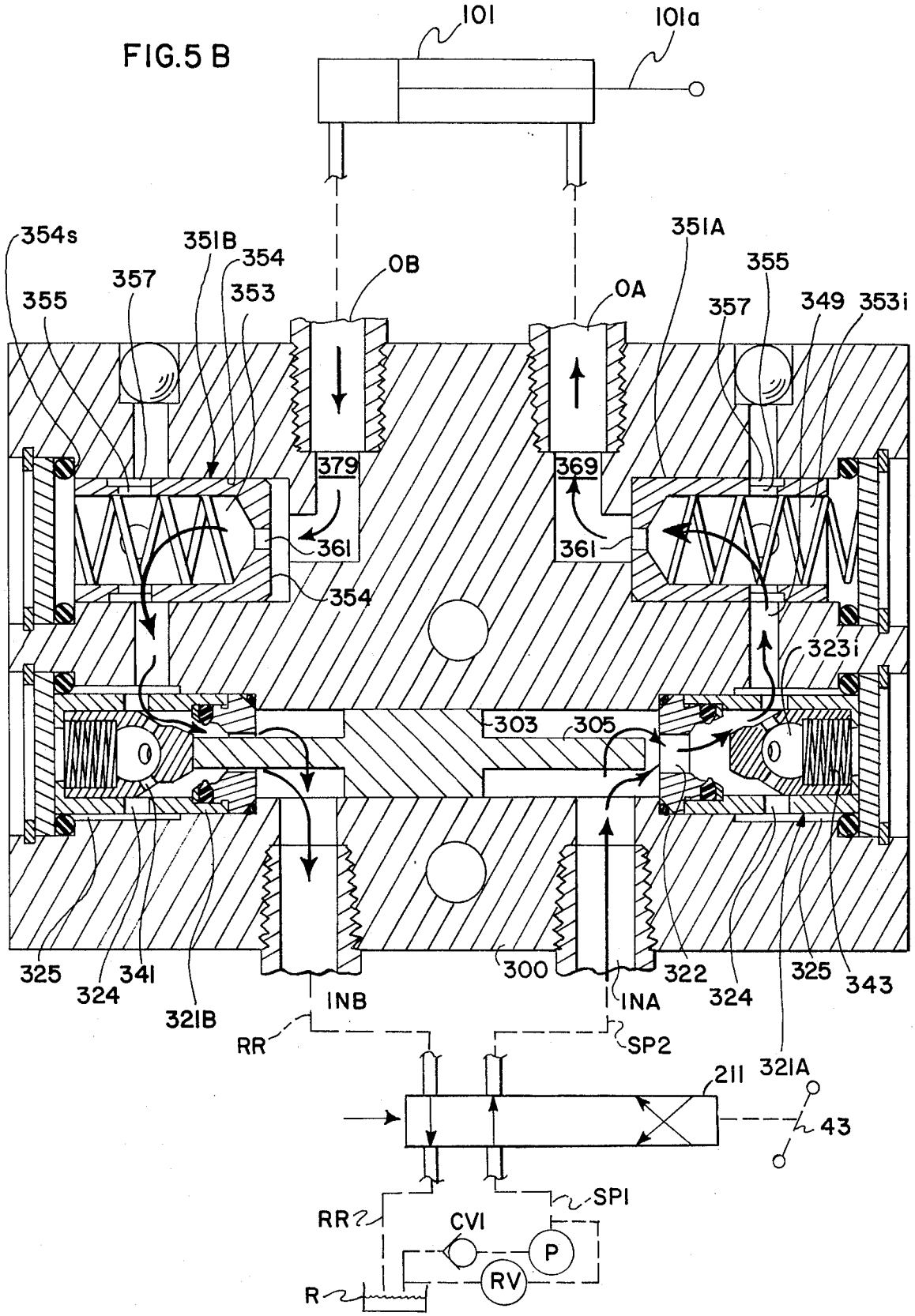

FIG. 5B is a view and illustration similar to that of FIG. 5A, with fluid supply pressure applied through the table top control function valve in one direction, and with liquid flow through the system in that direction to effect actuation of the respective illustrated table top function cylinder.

Figure 6:
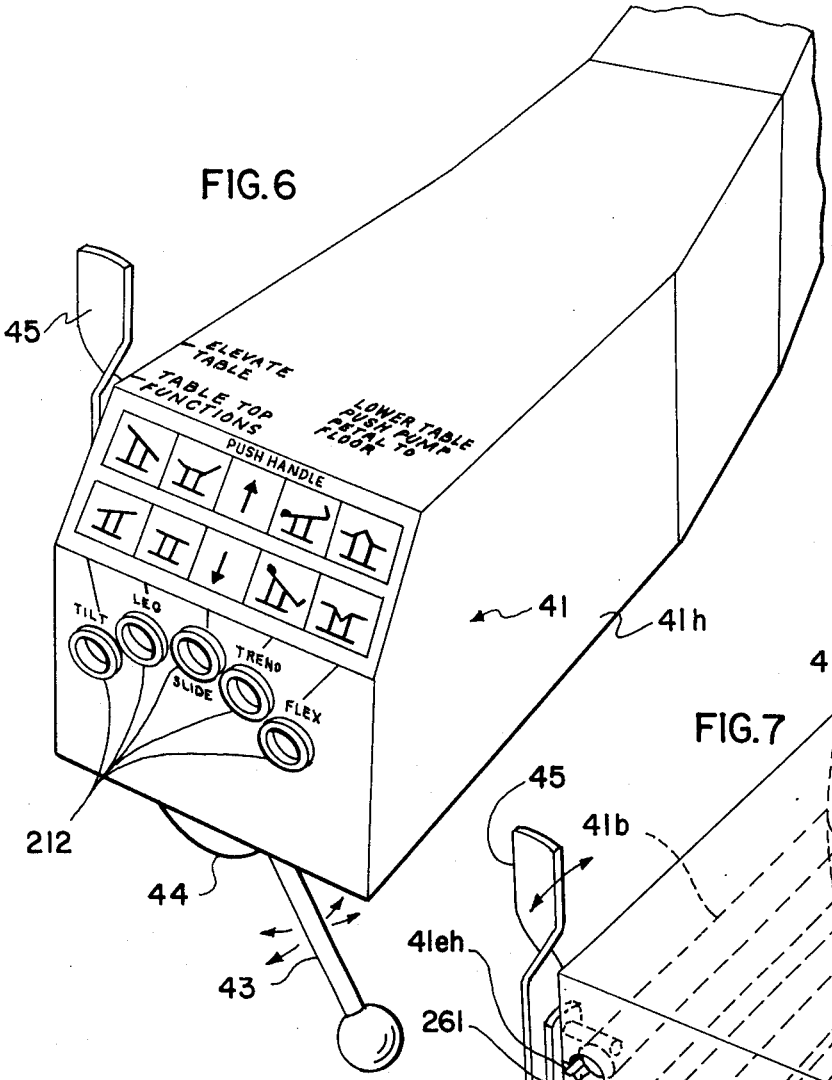

FIG. 6 is an enlarged perspective external view of the hydraulic control valve console.

Figure 7:
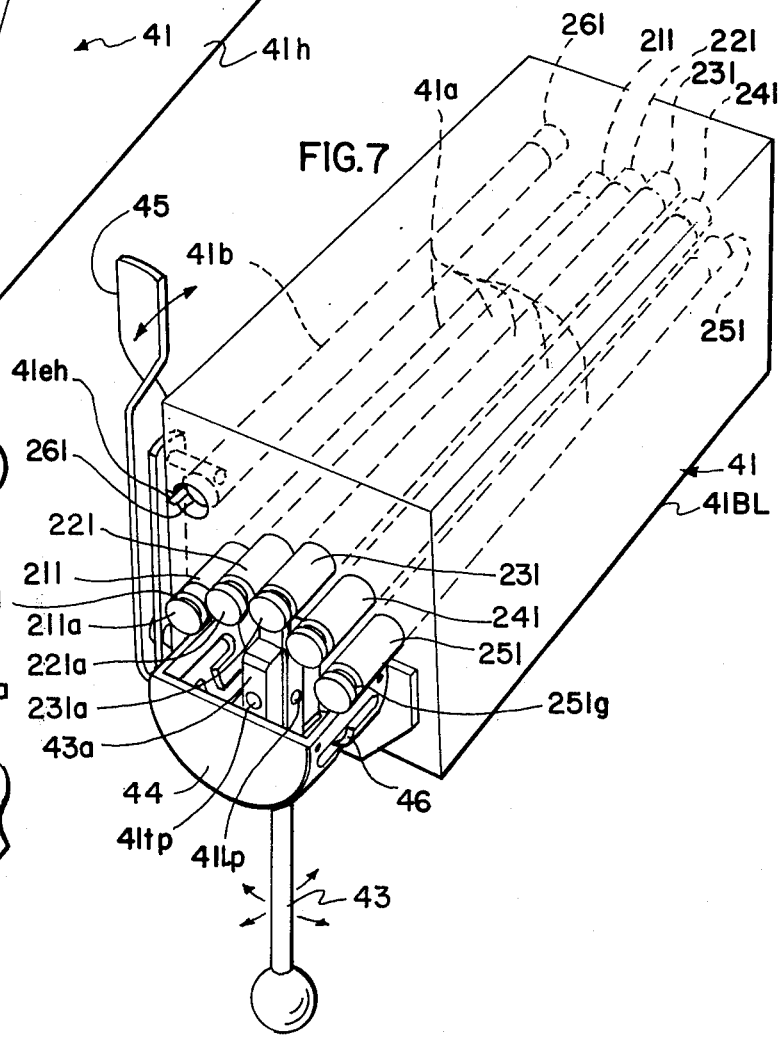

FIG. 7 is an enlarged perspective view of the hydraulic control valve arrangement incorporated in the hydraulic control console of FIGS. 1 and 6.

Figure 8:
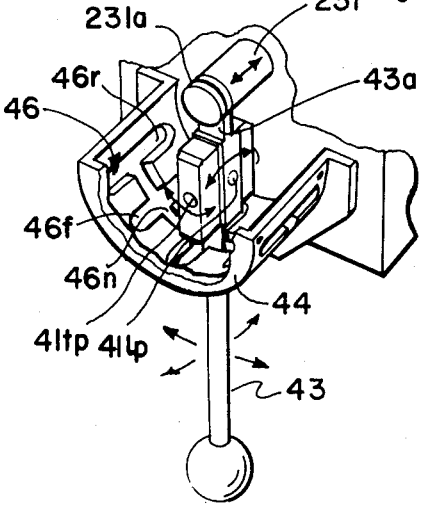

FIG. 8 is a partially cut away fragmentary view in perspective of the table top function control lever and of the hydraulic control valve arrangement of FIG. 7, illustrating the control lever shift cage or gate in more detail.

Referring now in detail to the Figures of the drawings, the invention is illustrated as applied to and embodied in an operating table 11 having a top 51 which is longitudinally slidably supported on a vertically adjustable pedestal 31 and base 21. The table top 51 has separate patient support sections 53, 55, 57, 59, which are pivotally secured together as by pivot pins 54, 56, 58, and the top is supported on the pedestal through pivot connections 58 and **170*m*, connecting between sections 53, 55 and a pair of slide frame U-channel support members 70, 170 which, together with transverse spreader plate 70*x*, form a slide frame 68 for slidably supporting the table top 51**.

Table top 51 patient support sections 53, 55, 57, 59 are respectively indicated as head, back, seat and leg sections for ease and conventionality of designation, although it will be appreciated that such sections may support other portions of a patient's anatomy or any given section may support all or a portion of a patient. These pivotally interconnected top sections 53, 55, 57, 59 are selectively articulatable about their respective interconnecting pivots 54, 56, 58, sections 55, 57, 59 being pivotally articulated by actuation of hydraulic cylinders 91, 191, and 71, 171, and head section 53 being manually selectively settably adjustably about pivot 54 relative to back section 55 as by suitable conventional or other desired mechanical means, not shown.

In addition, the entire table top 51 may be laterally tilted by the actuation of hydraulic tilt cylinder 101, which with its piston rod **101*a* may be suitable pivotally connected between a portion of upper vertical support element 37 of the pedestal 31 and a tilt frame 41, which is mounted through tilt pivot pin or pins 41-1*tp* carried by a longitudinal pivot beam 41*b* which in turn is mounted for forwardly and rearwardly angular movement about a horizontal axis pivot support pin 37***tp* connecting with and carried by main pivot support block 37. Support block 37 forms the height adjustable effective upper main support end of vertically adjustable pedestal 31.

The tilt frame 41 is formed by longitudinal tilt beam 41*b* which is pivotally connected through pivot pin or pins 41-1*tp* to two lateral beams 41*a*, the ends of which are secured, as by welding, to U-channels 41*c*, which connect through slide connections to a slide shaft 110 secured at its opposite ends to slide frame parallel U-channel support members 70, 170 on which the top 51 is articulatably mounted.

Trendelenberg forward and rearward pivotal movement of the table top 51 about the transversely extending horizontal pivot axis formed by pivot pin 37*tp* is effected by a Trendelenberg hydraulic cylinder 121 and rod 121*a* pivotally interconnecting between longitudinal pivot beam 41*b* and the pedestal upper main support block 37 or a suitable part fixedly secured thereto.

Sliding movement of the top 51 may be suitably effected by actuation of a slide hydraulic cylinder 111 which, with its rod 111*a* extends and connects between a connection point on the underside of the U-channel support 170 of slide frame 68 and a connection point on the underside of tilt frame U-channel 41*c*.

Leg section 59 may be selectively pivoted about pivot 58 through hydraulic pressure actuation of paired leg cylinders 71, 171, which are connected between the respective slide frame U-channel support members 70, 170 and the leg section 59, through their respective piston rods 71*a*, 171*a* and links 73, 173, the pivot connection of the free ends of rods 71*a*, 171*a* with links 73, 173 being guided by channel guides 75.

Flexing of the seat and back sections 57, 55 may be effected through paired flex hydraulic cylinders 91, 191 which, with their rods 91*a*, 191*a*, connect between seat section 57 and slide frame U-channel supports 70, 170, through suitable opposite end pivot connections. A suitable pivot/slide motion support arrangement for the back section 55 pivot support 170*m* may be provided in order to accommodate the pivotal and sliding movement required by back section 55 during flexing of sections 57 and 55 by cylinders 91, 191. This may suitably take the form of pivot connections on each of U-channels 70, 170, and being indicated for illustration on one side at 170*k*, 170*m*, 170*p*, with pivoted inverted L-shaped slide member 170*p* slidably supportingly engaged in a channel guide 55*b* secured to its respective side frame U-channel 55*a* of back section 55.

Sliding of the table top 51 and the various articulations of the table top sections 53, 55, 57, 59, individually or collectively, are generally referred to herein as table top functions, and may be effected through actuation of the various hydraulic cylinders 71, 171, 91, 191, 101, 111, and 121, as discussed above.

The various table top articulation cylinders 71, 171, 91, 191, 101, 111, 121 may be suitably controlled from a swingably adjustably mounted hydraulic control console generally indicated at 41, having a table top function control handle or lever 43 and an elevate control handle or lever 45, which latter control handle 45 may be employed to control elevate actuation of an elevate hydraulic cylinder 131 in the pedestal 31 to effect height adjustment of the table top 51 through height adjustment of pedestal upper main support block 37 carried by vertical piston rod 131*a* of elevate cylinder 131.

In order to provide minimum X-ray interference beneath the patient support top sections, the slide frame 68 is formed by two laterally spaced parallel longitudinally extending U-channel members 70, 170, which are connected desirably solely by a transverse spreader plate 70*x* which may be suitably secured thereto as by welding or other suitable securing means. Also, for ease of use in conjunction with X-ray photographic or image intensifier equipment, the various top sections 53, 55, 57, 59 are formed by spaced opposed parallel side U-channels 53*a*, 55*a*, 57*a*, 59*a*, to which are suitably secured top panels 53*b*, 55*b*, 57*b*, 59*b* formed of radio-translucent material such as Benelex composition board. The parallel side U-channels form a channel guide support for slidably inserting X-ray film casettes, which may thereby be slidably removably supported beneath any desired section or sections of the table top radio-translucent panels 53*b*, 55*b*, 57*b*, 59*b*.

The slide frame 68 has slide shafts 110 disposed within each of the channels formed by U-channel members 70 and 170, the slide shafts 110 being secured in place by shaft mounting blocks 124, which in turn are adjustably secured to the opposite ends of the U-channels 70, 170, as through the medium of securing screws or bolts, for desired parallel positioning of the slide shafts 110 in each of the respective U-channel members 70, 170. The slide shafts 110 of slide frame 68 slidably ride in low friction slide bushings, such as linear ball bushings (not shown) secured at spaced positions on the laterally outer walls of tilt frame U-channel members 41*c*, thereby enabling sliding movement of the slide frame 68 and the table top 51 carried thereby.

Figure 3:
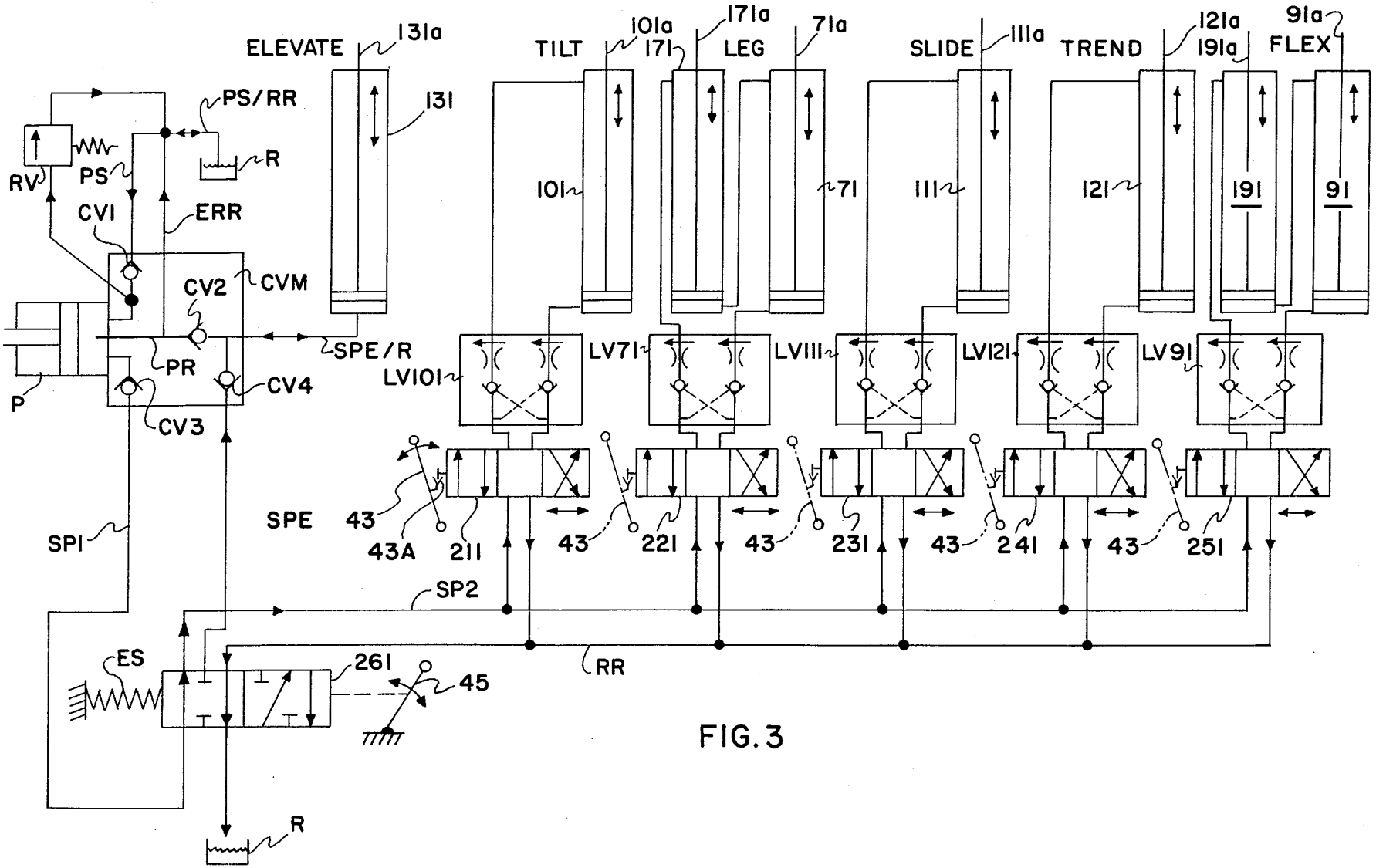
FIG. 3 is an over-all hydraulic circuit diagram in accordance with the invention.

The hydraulic circuit for controlling the various functions of the operating table 11 is schematically shown in FIG. 3, and in FIG. 2 the general interconnection of the various hydraulic lines to the actuating cylinders is schematically illustrated, the table top 51 being shown in the flexed position of the seat and back sections for illustrative purposes and simplicity of illustration.

The foot pump P is suitably connected through a multiple check valve assembly CVM between the tank reservoir R and the various function cylinders for the table, including tilt cylinder 101, leg cylinders 71, 171 slide cylinder 111, Trendelenberg cylinder 121 flex cylinders 91, 191. Also connecting between the various respective movement actuation cylinders and the foot pump P and reservoir R are respective table top function control valves which are generally indicated and designated at 211, 221, 231, 241, 251, for the respective cylinders 101, 71/171, 111, 121, and 91/191. In addition, an elevate control valve, generally indicated by numeral 261, is dispose for fluid connection to the elevate cylinder 131 in the pedestal 31. These table top function control valves may be suitably formed by respective slidable flow control spools which together with the internal connecting fluid passageways in a valve block 41, to be later described, accomplish three-mode neutral "off", and reversable fluid flow valve operation, for actuation of the table top function cylinders 101, 71/171, 111, 121, and 91/191. The desired functions of the elevate control valve 261 may be suitably performed by a slidable spool and associated passageways in the valve block 41, as later described. Accordingly, for ease and simplicity of illustration and discussion, the valve designations 211, 221, 231, 241,

251, and 261 are utilized both to indicate the table top function and elevate cylinder control valves and the flow control spools which form the movable primary element of the respective flow control valves for the movement effecting cylinders.

The elevate valve 261 serves an important dual purpose of providing a valve control for pressurizing the piston or pressure end of the elevate cylinder 131, while also effecting override control of the application of supply fluid under pressure to any of the table top function control valves 211, 221, 231, 241, and 251. Thus, when the elevate control spool or valve 261 is in the non-elevate mode position as indicated in FIG. 3, a fluid supply pressure connection is formed between the foot pump P and a common pressure manifold to the pressure inlet side of each of the table top function control valves 211, 221, 231, 241, 251. This enables the application of fluid pressure to either end of the respective desired table top function cylinder 101, etc., upon selected manual sliding movement of the selected associated control valve 211, etc. to its operative position for the requisite fluid flow to and from the respective actuation cylinder 101, etc. This actuation of the respective table top function control spool may be effected through selected pivotal movement of the manual table top function handle or lever 43 which, as will be subsequently described, employs a yoke 43*a* selectively actuatably engageable with only a single one of the table top function control spools 211, 221, etc., at one time, and requires also the neutralizing of any individual table top function flow-control spool prior to disengagement or engagement of the yoke 43*a* with respect to the respective such table top function spool.

While it is feasible to operate the cylinders 101, etc. directly from the function control valves 211, etc., it is desirable to provide a check valve and flow control arrangement between the individual function control valves 211, etc. and their respective hydraulically actuating cylinder 101, etc. To this end, lock valves LV101, LV71, LV111, LV121, and LV91 are provided in flow control arrangement between each of the actuated table top function cylinders or pairs of cylinders and its respective function control valve. The general purpose and function of the lock valves LV101, etc. is to block return fluid flow from the respective table top function cylinder 101, etc, at all times except when pressure is applied from the pump P through the respective function control valve (e.g., 211, etc.) therefor, and to provide a flow control return means to prevent abrupt movements of the actuating cylinders as a function of abrupt changes of fluid pressure applied to the actuating cylinders and/or abrupt changes in load on the respective actuating cylinders. To this end, each lock valve LV101, etc. includes oppositely acting check valves 321A, 321B each of which is actuated to open both in response to pressure from the pump P through the respective function control valve 211, etc. and also through mechanical opening thereof by a double-acting interconnecting free floating pilot piston actuator 301 which senses differential pressure between the two supply inlet lines to the lock valve and its check valves 321A, 321B.

In addition, the lock valve (e.g., LV101, LV71, etc.) is provided with pressure compensated flow control valves 351A, 351B which function to restrict the flow of liquid therethrough as a function of the pressure in the line, thereby preventing abrupt changes in fluid flow as a result of supply and/or load-induced abrupt pressure variations.

The multiple check valve assembly CVM includes check valves CV4 and CV2 which serve to enable raising and lowering action of elevate cylinder 131. Table top raising action by the elevate cylinder 131 is effected by movement of elevate control spool 261 to the left-most position as shown in FIG. 3, against the action of return spring ES, thereby enabling the application of fluid pressure from the foot pump P through the check valve CV4 and to the piston end of the elevate cylinder 131. A push rod PR slidably movable in a bore formed in the check valve assembly CVM or other suitable body member, is mechanically engageable by the foot pump piston at the bottom end of its travel to effect axial sliding motion of the push rod PR so as to mechanically open the elevate return check valve CV2, and thereby enabling return flow of liquid from the elevate cylinder 131 under force of gravity acting on the loaded or unloaded table top and associated support assembly, with the fluid thereby exiting from the elevate cylinder 131 through elevate supply pressure/-return reservoir line SPE/R, check valve CV2, and elevate return reservoir line ERR, to the tank reservoir R. The push rod PR is suitably sealed in the zone adjacent the pump end thereof to prevent undesirable passage of fluid to or from the pump cylinder by passage about and past the push rod. However, the sealed push rod is provided with a suitable bore clearance at the end thereof adjacent the check valve CV2 to enable liquid passage therepast while the check valve CV2 is opened by the push rod through extreme bottoming of the foot pump stroke. Check valves CV1 and CV3 are arranged in reverse flow control relation between a pump supply line PS aand pump supply/return reservoir line PS/RR on the one hand and supply pressure line SP1 on the other hand, in order to enable suction and supply of liquid under pressure by the foot pump P, to thereby effect pressurized actuation of any selected one of the table top function actuation cylinders 101, etc. or elevate cylinder 131.

As previously noted, in order to prevent inadvertent reverse bleeding of liquid from the table top function cylinders 71/171, 91, 191, 101, 111, 121 through the control valves 211, 221, etc. and back to tank reservoir R as a result of external load on the top 51 and a given table top function cylinder or cylinders, and to minimize abrupt acceleration or deceleration of the table top function cylinder operations, and concomitantly the table top 51, due to supply-and/or external load-induced cylinder pressure variations, a compact unitary pressure-compensated pilot-operated lock valve unit LV91, LV91, LV101, LV111, and LV/21 is interposed in the supply/return lines between each table top function valve (e.g., tilt control valve 211 of the hydraulic control valve unit 41) and its associated table top function hydraulic cylinder (e.g., tilt cylinder 101). Each of these lock valves LV71, LV91, LV101, LV111, and LV121 is formed as a compact totally enclosed block unit having four simple external line connections INA, INB, OA, and OB and two thrumounting holes MH extending through the one-piece valve housing or block 300. These compact lock valves may be easily and conveniently mounted on the support structure beneath the table top 51, as shown in FIGS 1 and 2, the lock valves LV71, LV91, and LV111 being simply and easily accessibly mounted, as by bolts or screws, on the top of transverse spreader plate 70*x*, and the lock valves LV101 and LV121 being mounted on longitudinal tilt beam 41*b* for ease of access and ease of line connections to the associated table top function cylinders.

It is not necessary to utilize the special lock valve arrangement for the elevate cylinder 131, as return flow is normally blocked by check valve CV2 which, as previously noted, is selectively mechanically relieved by push rod PR being selectively moved by the foot pedal FP at the extreme bottom of its travel; the relievable check valve CV2 being employed between the elevate cylinder and the tank reservoir to enable lowering movement, with simple selectively actuated up-pressure flow control valve 261 for elevate operation thereof, and the normally large volume of the elevate cylinder will itself smooth out any up or down elevation movements resulting from abrupt changes in elevate supply liquid pressure.

Referring now in further detail to FIGS. 5A and 5B, a lock valve arrangement according to the invention is illustrated in more detail in conjunction with the tilt cylinder 101 of the operating table of FIGS. 1 and 2. As shown in FIG. 3, each of the other lock valves LV71, LV91, LV111 and LV121 is similarly arranged with respect to its associated table top function cylinder or cylinders. The single illustrative flow controlled actuating assembly is shown in FIGS. 5A and 5B by way of example of the arrangements of the other table top function cylinder and lock valve assemblies.

Lock valve LV101 is arranged in fluid flow control relation between the selective control valve 211 and the tilt cylinder 101, through hydraulic line connections connecting with the respective ports INA, INB, OA, OB. The ports INA and INB are designated as inlet ports for convenience, although flow may occur therethrough in both directions, as will be later noted, and similarly ports OA and OB are designated as outlet ports, although likewise fluid may flow through each of these ports in opposite directions, as will be later discussed. The designation of these ports in this fashion is utilized to indicate the input or supply pressure application through the respective ports INA and INB, this being the only manner in which the liquid is permitted to flow through the lock valve LV101, as will be later described.

As previously described, foot pump P is connected through supply pressure line SPI to the control valve 211, and pump P connects with the tank reservoir through a check valve CVI and a relief valve RV. Return reservoir line RR connects between the control valve 211 and the tank reservoir R.

The lock valve LV101 incorporates a housing 300 formed of a single integral block of metal or other suitable material, which may have thru mounting holes MH for mounting at selected positions on the support structure of the operating table 11 or other equipment used therewith, as discussed above.

Transverse stepped bores are formed in the housing block 300, within which are secured respectively oppositely acting check valves 321A, 321B, each of which is arranged to act to prevent reverse or out flow through the associated respective inlet port INA and INB in the normal unpressurized condition of ports INA and INB as shown in FIG. 5A. Disposed in a central bore 311 extending between the two interfacing check valves 321A, 321B, is a double-acting pressure-responsive pilot-actuated piston 301. Each of the check valves 321A is identical, and accordingly identical reference numerals are utilized for the parts of both of these check valves 321, with the exception of the over-all general designation thereof as 321A and 321B.

Each of the check valves 321A, 321B is provided with a piston 329 slidable in a cylindrical bore formed in the check valve housing 323. Check valve pistons 329 are resiliently biased to closed condition in contact with their respective o-ring seals 327*s* at the nose end tapered seat face 329*a* thereof, as by a light compression spring 343. O-ring seal 327*s* may be suitably secured in place through the medium of retention ring members 327*b* and 327*a*, the o-ring seal 327*s* being laterally squeezed between and extending radially inwardly into the ring opening in these two ring members to form the annular seat for engagement with the tapered seat face 329*a* of the piston 329. End plug ring member 327*a* has an exit/entrance end bore 322 formed therein, and may be press-fit or staked in place in the end of the housing 323. An o-ring seal 331*s* is disposed between an annular chamfer on the retention plug ring 327*a* and the shouldered bore within which the respective check valve 321A, 321B is inserted, to thereby effect a fluid seal in this zone. The check valves 321A, 321B are secured in their respective end bores in the block 300, through the medium of a cap seal 335, and o-ring seal 333*s* and a retention snap ring 337.

Fluid communication through each respective check valve 321A, and 321B is enabled through the exit/entrance bore 322, and passage past the o-ring seal 327*s* and tapered seat face 329*a*, past the tapered end of piston 329, and through a plurality of radial bores or holes 324 formed in the housing 323, there being an annular step groove 325, as by a counterbore in the block 300, about the annular exterior of the check valve housing 323 in the vicinity of port holes 324, which annular groove 325 connects with a bore 349 adjoining check valve 321A, and a bore 389 adjoining check valve 321B, to thereby enable fluid flow through the respective check valve upon opening of the valve as a function of positive pressure in the respective inlet port INA, INB or through the mechanical pushing action on the nose end 329*b* of the piston 329 by the double-acting pilot piston 301 as a function of positive inlet pressure from pump P at the opposite INB or INA port from the particular valve 321A, 321B. Bores 341 in piston 329 enable pressure relief between the interior 323*i* and exterior of hollow piston 323.

The double-acting pressure-responsively slidable actuator piston 301 has two oppositely extending stems 305, 307 which, in the neutral position of piston 301, as shown in FIG 5A, extend into each of the exit/entrance bores 322 of the respective check valves 321A, 321B the stems 305, 307 being substantially-diametrally undersized with respect to the bores 322, so as to enable ease of fluid passage through a bore 322 while the respective stem is disposed therein. The piston 301 also has a pressure-responsive actuating face 303 against which the pressure in the respective bore INA and INB acts to effect sliding movement of the piston 301 to open the opposite side check 321A or 321B, as the case may be. In operation, as shown in FIG. 5B, it will be seen that the application of positive fluid pressure from pump P to either of the inlet ports INA, INB will result in fluid pressure actuated displacement of the respective check valve piston 329 away from its o-ring seat 327*s*, to thereby open the valve, and will also effect sliding movement of the pilot-operated piston 301 in the opposite direction to mechanically unseat the opposite piston 329 and open the other check valve, thereby enabling liquid passage through both valves 321A, 321B under this condition. Under all other pressure conditions, the two valves 321A, 321B will be closed, as shown in FIG. 5A, as a function of the spring pressure exerted by springs 343 which act to move the pistons 329 into seated sealing engagement with their respective o-ring seals 327*s*.

While other check valves or check valve constructions may be utilized in practice of the broad invention, the illustrated embodiment is preferred in view of its very good reverse or check flow sealing ability, its compact size and ease of functional structural accomodation and operation in the overall arrangement, and its ease of drop-in insert assembly in and removal from the valve unit block 300.

Bores 349 and 389 may be suitably formed to the desired depth in block 300 and sealed at their outer end by press-fit ball plugs BP, for ease of construction. The outer end portion of the bores is only a result of this mode of construction and serves no further purpose or function.

Pressure responsive flow control valves 351A, 351B are each identical and disposed in opposite pressure responsive relation. Each valve 351A, 351B includes a slidable hollow flow control piston 353 resiliently biased toward its face end 354 by a compression spring 359 acting between the face end 354 and a cap seal 365. Cap seal 365 and o-ring seal 363 are seated against a counterbore annular shoulder 354*s* concentric with the cylindrical bore 354 within which piston 353 slides. A snap ring 367 secures the drop-in piston and seal assembly 353, 359, 363, 365 in place and enables ease of assembly, as well as dis-assembly as may be required for servicing.

Piston 353 has an annular groove 357 and circumferentially spaced radial port holes 355 formed in its wall directly and fully adjoining and in full fluid flow registry with bores 349, 389 in the seated position of the piston 353, as shown in FIG, 5A, thereby permitting full flow through the bores 349, 389 to the full extend permitted by the size of the various passageways in the system.

The piston end face 354 has a central bore 361, smaller than the adjacent diameter of the respective bore 369, 379, whereby a pressure differential may be created between the exterior end face and the hollow interior of piston 353 during flow in the direction acting against spring 359. A pressure differential will, of course, also appear in the opposite 359. For either of the valves 351A, 351B under this condition, the piston 353 will be slidably moved against the action of spring 359, thereby reducing the effective fluid passageway formed at the intersection of annular groove 357 and the particular connecting bore 349 or 389. This will reduce the flow rate until the spring 359 and the net fluid pressure acting against spring 359 are in equilibrium, and this pressure compensated flow control action will continue during the time that check valves 321A, 321B are open in the manner as previously discussed. The net result of this actuation control subsystem is P, 211, LV101, 101 is to provide both a positive fluid flow shut-off control preventing fluid flow from the table top function cylinder 101 when the valve 211 is closed, independent of load variations, and to provide a pressure compensated smoothing of the flow rate of the liquid to and from the cylinder 101 during desired selected positive supply of fluid pressure thereto from pump P.

While the invention has been illustrated and described with respect to a particular illustrative and preferred embodiment, it will be apparent that various modifications and improvements may be made without departing from the scope and spirit of the invention. Accordingly, the invention is not to be limited by the particular illustrative embodiment, but only by the scope of the appended Claims.

Referring now more particularly to FIGS. 4A–4D and 6–8, the hydraulic control unit 41 for manually selectively controlling the elevation and table top function operations is in the illustrated and preferred embodiment formed from a single block 41BL of metal or other suitable material, with various passageways formed therein as by normal machine boring operations. For simplicity of illustration, the control valve is illustrated in FIGS. 4A–4D with the elevate control valve spool 261 and a single table top function valve spool 211. Also, for ease and clarity of illustration the various bore passageways are shown in one plane, and exiting at the sides of the block 41BL, although it will be appreciated that in actual commercial practice the various bores may be formed at various angles and in various planes, and exit at the rear end of the block for ease of accommodation of all five function control valves 211, 221, 231, 241, 251, and to enable ease and compactness of fluid connections thereto from the various other elements of the hydraulic system.

Referring generally to FIGS. 6 and 7, the various control valves 211, 221, 231, 241, 251, 261 are formed by correspondingly numbered slidable spools disposed for selective sliding within corresponding complementary spaced parallel longitudinal thru bores 41*a*, 41*b*, formed in valve block 41BL.

Elevate valve spool 261 is slidable back and forth between a normally forward non-elevate position to a rearward elevate-effecting position. This spool 261 is spring biased by spring ES in the block 41BL, resiliently biasing the elevate handle lever 45, to move the spool 261 a front stop position, at which front position the valve spool 261 opens a port passageway connection from the pump P to a common pressure manifold 41*c*5 (see FIGS. 4A, 4B and 4C) which is a common fluid connection to each of the table top function valve spools 211, 221, 231, 241, 251. This connection of pump P to the common pressure manifold 41*c*5 enables any one of the table top function cylinders to be actuated in either direction by sliding the corresponding valve spool 211, 221, 231, 241, 251 appropriately forward or rearwardly for the desired table top action.

Each of the table top function valve spools 211, 221, etc. is normally positioned in a neutral longitudinally centered, closed condition as shown in FIG. 1, and is resiliently releasably retained in this position by a spring biased ball detent 213 engaging an annular groove 211*b* on the valve spool. Movement of any desired valve spool from neutral closed position to an open condition at either end of its travel is effected by manual lateral pivoting of the handle lever 43 to angular alignment with the desired table top function valve spool. This action and arrangement is illustrated in FIGS. 6–8. The upper free end of of handle lever 43 has a spool engaging shifter element 43*a*, which may suitably take the form of a male member engaging in an annular shift groove (e.g., 211*g*) formed in and adjacent the end of the respective valve spool, as shown generally in FIGS. 7 and 8, or the shift element 43*a* may take a female form in the form of a yoke shiftably engaging a knob end 211 of the valve spool 211, 221, etc., as schematically shown in FIGS. 3 and 4A–4D. In either case the shifting action is essentially the same, as the handle lever 43 is pivotable about both a longitudinal axis and a transverse axis perpendicular thereto, as about universal-joint-forming pivot pins 431*p*, 43*p*.

The multiple pivotal shifting movement of table top function control handle lever 43 is guided by a curved guide plate 44 having a multiple-H-slot guide slot 46 formed therein and through which the lever 46 extends. The guide slot 46 has a longitudinally extending leg slot section with opposite end zones 46*f*, 46*r* defining the forward and rearward travel path of the lever at the index position for each table top function valve spool 211, 221, 231, 241, 251. A neutral guide slot section 46*n* is formed between each spool index zone 46*f*, 46*r*, thereby assuring that the various table top function valve spools 211, etc., will be moved to the neutral "off" position in their respective bores 41*a* prior to shifting disengagement or engagement of the lever shifter element 43*a* therewith. The spools 211 will then be self-retained in this neutral "off" position by the action of detent ball 213 and groove 211*b* (FIG. 4A), until the given spool is subsequently engaged and shifted forwardly or rearwardly by the lever shift element 43.

The particular indexed position of the lever handle 43 may be suitable indicated to the operator through employment of open viewing ports 212 in the front cover of housing 41*h*, as shown in FIG.6, with the front of the upper portion of handle lever 43, or some suitable viewable element movable therewith, being visible through the index view port 212 corresponding to the function valve spool for the table top function as indicated on the front of the housing.

Figure 4A:
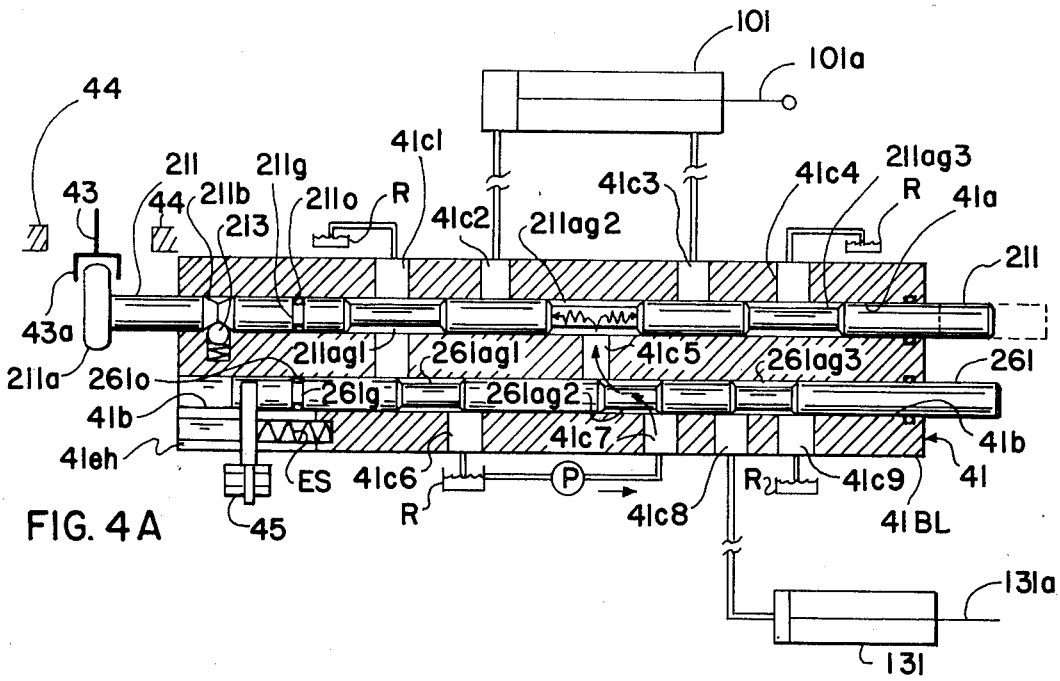

The elevate valve spool 261 is shifted by handle lever 45 which is suitable pivotally mounted on the block 41BL, with mechanical actuating connection between the lever 45 and the valve spool 261 through a side slot 41*eh* in the valve block 41BL. Compression spring ES may be disposed in a bore extending along slot 41*eh*, to thereby exert its resilient bias against handle lever 45 toward the normal non-elevate position as shown in FIGS. 7 and 4A.

Referring again to FIGS. 4A–4D, as previously noted the normal non-elevate position of valve spool 261 ports pump P to the common pressure manifold 41*c*5 for each of the table top function valve spools 211, 221, etc., whereby any one of the table top functions may be selectively effected by appropriate forward or rearward sliding movement of the appropriate valve spool 211 to the forward or rearward end of its travel within multiple-H-slot 46, as defined by guide 44 and longitudinal slot sections 46*f*, 46*r*.

Each table top function valve spool is provided with three annular porting grooves indicated at 211*ag*1, 211*ag*2, and 211*ag*3 for spool 211, and the elevate valve spool 261 is also provided with these annular porting grooves 261*ag*1, 261*ag*2, and 261*ag*3. Each of the spools 261 and 211, 221, etc. is sealed adjacent the opposite ends of its bore by o-rings 261*o*, 41*bo*, and 211*o*, 41*ao*, etc. No further o-rings are required, and in order to facilitate assembly and disassembly of the valve spools in valve block 41BL, the o-rings 41*ao* and 41*bo* adjacent the rear insertion ends of the table top function valve spools 211, 221, etc. and elevate valve spool 261 are disposed in grooves 41*ag*, 41*bg* cut in the respective spool bore 41*a*, 41*b*, rather than in the valve spool itself, as this enables ease of insertion of the valve spool without hangup and mutilation of the o-ring seals as they pass the various lateral bore passageways in the valve block 41BL. Chamfering of the rear insertion end of the valve spools aids in ease of insertion of valve spools past the bore-contained o-ring seals 41*ao*, 41*bo*. The o-ring seals 211*o*, 261*o*, etc. sealing the front ends of the bores 41*a*, 41*b* may be suitably disposed in annular grooves 211*g*, 261*g* formed in the front end of the corresponding valve spools 211, 261, etc.

The annular porting groove 211*ag*2 table top function valve spool 211, 221, etc., and the annular porting groove 261*ag*2 serve for selecting pressure porting between the pump P and the table top function and elevate cylinders 101, 102, etc. and 261. The outboard annular porting grooves all serve to provide return connections to tank reservoir R, and as they are disposed inboard directly adjacent the end o-ring seals it will be noted that pressure buildup is prevent against o-ring seals due to any fluid leakage along the bore/-valve spool interface in the operating zones between the end o-ring seals 211*o*, 41*ao*, 261*o*, and 41*bo*.

In the neutral position of valve spool 211 and the normal non-elevate "off" position of valve spool 261, pump pressure is ported only to manifold pressure port bore 41*c*5, and is blocked by the spool 211 at each shoulder or land area end of the annular porting groove 211*ag*2. Likewise the inlet port connection 41*c*7 to valve unit 41 from pump P is blocked from connection with elevate cylinder 261 by the shoulder or land area formed at the rear or right end of porting groove 261*ag*2. All porting grooves 211*ag*1, 211*ag*3, 261*ag*1 and 261*ag*3 are in communication with tank reservoir through respective ports 41*c*1, 41*c*4, 41*c*6, and 41*c*9. This tank reservoir porting is maintained for all four combinations of positions of the valve spools 261 and 211, 221, etc., as will be noted in each of FIGS. 4A, 4B, 4C and 4D.

Figure 4B:
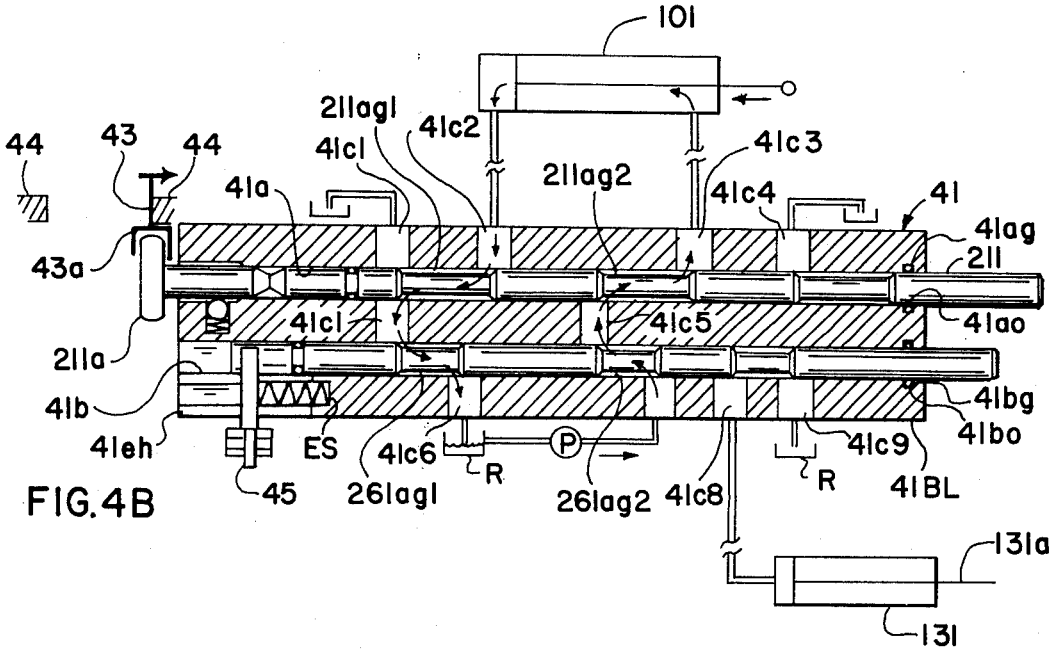

In FIG. 4B, the table top function (e.g., tilt) valve spool 211 has been moved to the rearmost inner position against guide stop 44, and pump pressure is connected to the rod end of table top function cylinder 101 through ports 41*c*7, 211*ag*2, 41*c*5, 211*ag*2, and 41*c*3, with return to tank reservoir connection being formed through ports 41*c*2, 211*ag*1, 41*c*1, 211*ag*1, and 41*c*6. This effects movement of the cylinder rod in tension and to the left as viewed in FIG. 4A.

Figure 4C:
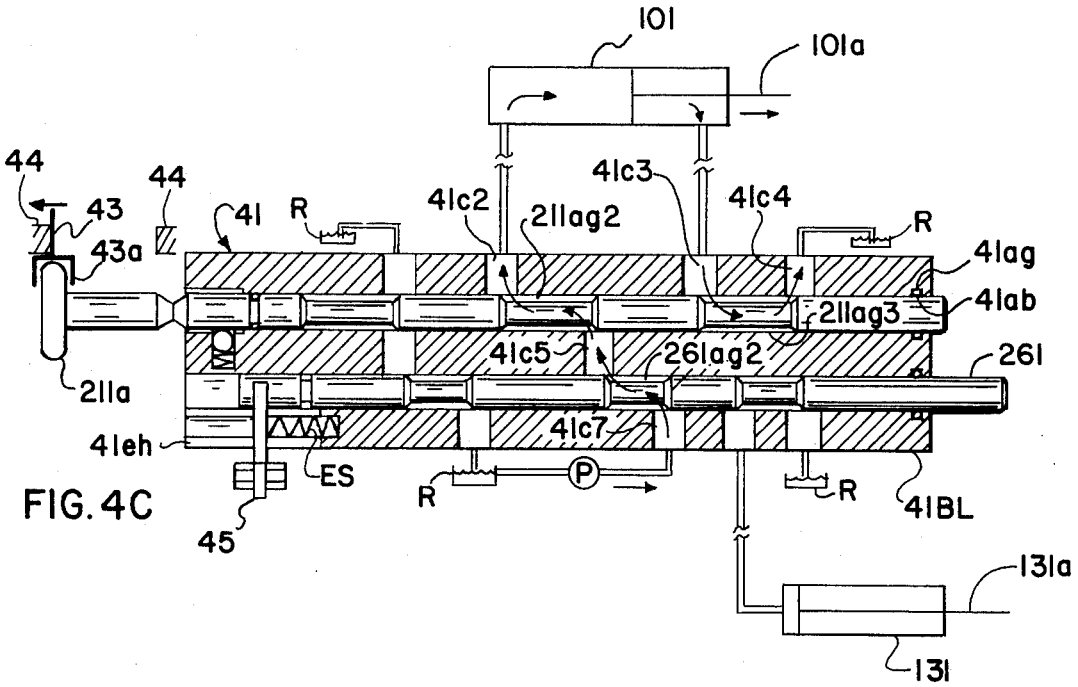

In FIG. 4C the valve spool 211 has been moved to the front or left as viewed in this Figure, and ported pressure connection is established from pump P to the piston end of tilt table top function cylinder 101 through ports 41*c*7, 216*ag*2, 41*c*5, 211*ag*2, and 41*c*2, with return to reservoir connection being effected from the rod end of the cylinder 101 by ports 41*c*3, 211*ag*3, and 41*c*4.

Figure 4D:
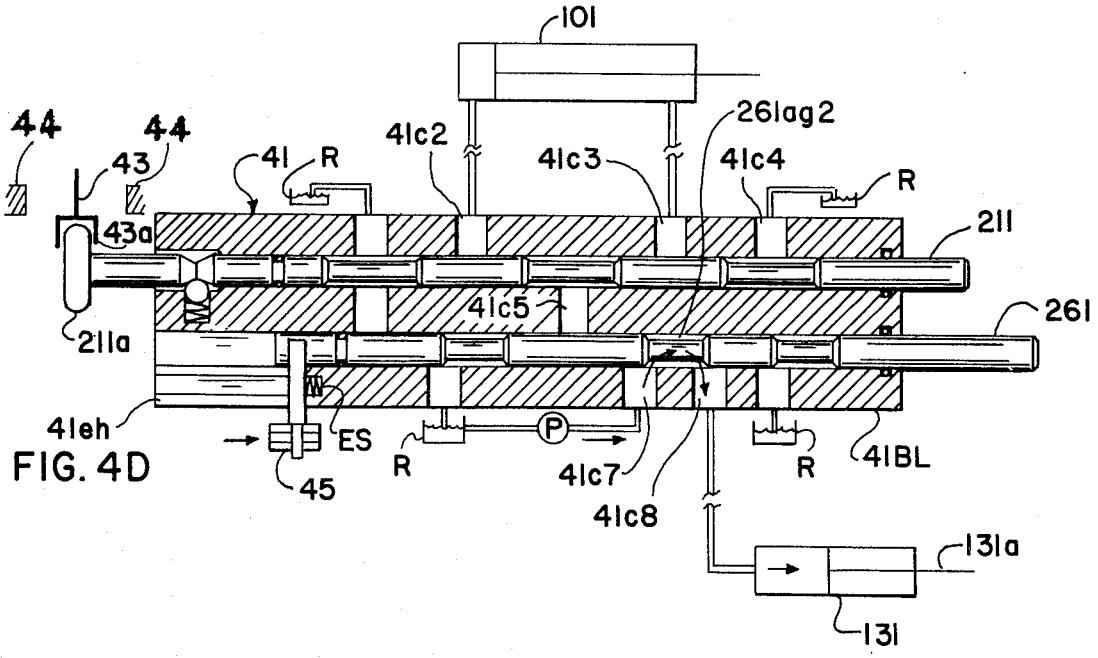

In FIG. 4D the tilt table top function valve spool is in the neutral "off" position, and the elevate valve spool 261 is moved to the far rear or right end of its travel against the return bias action of compression spring ES. In this position pump pressure is blocked off to common manifold port 41*c*5 by the spool and land area engaging the bore between valve inlet port 41*c*8 and common manifold port 41*c*5 for the table top function valve spools 211, etc. A fluid pressure passageway connection is formed to the piston end of elevate cylinder 131 in this position of the elevate spool 261, through ports 41*c*7, 261*ag*2, and 41*c*8.

While the invention has been illustrated and discribed as embodied in a particular illustrative embodiment it will be apparent to those skilled in the art that various modifications and improvements may be made without departing from the scope or spirit of the invention. Accordingly the inventtion is not to be limited by the particular illustrative embodiment, but only by the scope of the appended Claims.

We claim:

1. A hydraulic control valve arrangement for an operating table having a table top function-actuating cylinder for effecting a table top function and an elevate actuation cylinder for effecting elevation movement of the table top or the like and a pump for pressurizing said cylinders, and a fluid reservoir, said control valve arrangement comprising:

table top function valve means for selectively enabling and disabling fluid flow actuation connection to and from said table top function cylinder between said pump and said fluid reservoir, elevate valve means effecting, in one position thereof, fluid flow actuation connection to and from said elevate cylinder between said pump and said reservoir, and effecting in said same one position overriding fluid flow actuation disconnection in the connection between said pump, said table top function cylinder and reservoir.

2. An arrangement according to claim 1, said elevate valve means, in said one position thereof, effecting overriding fluid flow pressure disconnection from said table top function cylinder.

3. An arrangement according to claim 2, for an operating table having a plurality of table top function cylinders, further comprising:

individual table top function valve means for enabling and disabling fluid flow action connection to and from respective ones of a plurality of said table top function cylinders, a fluid supply pressure manifold in common port connection to each of said table top function control valve means, said elevate valve means in said one position effecting pressure disconnection from said pump to said common fluid pressure manifold and pressure connection to said elevate cylinder, and in a second position effecting fluid disconnection from said pump to said common fluid pressure manifold and disconnection of fluid pressure from said pump to said elevate cylinder.

4. An arrangement according to claim 3, further comprising:

a common actuator for separately actuating selected ones of said individual table top function valve means, and a separate actuator for actuating said elevate valve means.

5. An arrangement according to claim 4, each of said table top function and elevate valve means comprising:

a slidable valve spool, and a common valve block having parallel spool-receiving bores for slidable movement of said valve spools therein and having interconnecting ports therein which in conjunction with said valve spools enable said spools to effect said fluid flow connections and disconnections.

6. An arrangement according to claim 5, said table top function valve spools and parallel bores therefor being positioned side-by-side along an arcuate imaginary line, said common actuator being a swingably pivoted lever having a universal pivot axis lying generally at the center of the radius of curvature of said arc, said common actuator being a manual lever selectively movably engagable with and disengagable from said table top function valve spools.

7. An arrangement according to claim 6, and a guide gate guiding movement of said common actuator lever, said guide gate having guide means preventing shift disconnection of said common actuator lever from a said table top function spool at other than the neutral "off" position thereof.

8. An arrangement according to claim 7, said guide gate having a multiple-H-slot guide slot formed therein within which said common actuator extends and is thereby guided.

9. An arrangement according to claim 8, and a pilot-operated lock valve and pressure-compensated flow control valve disposed in flow control between each said table top function valve means and the associated said table top function cylinder.

10. An arrangement according to claim 1, and separate actuators for actuating said table top function valve means and said elevate valve means.

11. An arrangement according to claim 10, each of said table top function and elevate valve means comprising:

a slidable valve spool, and a common valve block having parallel spool-receiving bores for slidable movement of said valve spools therein and having interconnecting ports therein which in conjunction with said valve spools enable said spools to effect said fluid flow connections and disconnections.

12. An arrangement according to claim 10, each of said table top function valve means comprising:

a slidable valve spool, and a common valve block having parallel spool-receiving bores for slidable movement of said valve spools therein and having interconnecting ports therein which in conjunction with said valve spools enable said spools to effect said fluid flow connections and disconnections.

13. An arrangement according to claim 12, said table top function valve spools and parallel bores therefor being positioned side by side along an arcuate imaginary line, said common actuator being a swingably pivoted lever having a universal pivot axis lying generally at the center of the radius of curvature of said arc, said common actuator being a manual lever selectively movably engagable with and disengagable from said table top function valve spools.

14. An arrangement according to claim 13, and a guide gate guiding movement of said common actuator lever, said guide gate having guide means preventing shift disconnection of said common actuator lever from a said table top function spool at other than the neutral "off" position thereof.

15. An arrangement according to claim 14, said guide gate having a multiple-H-slot guide slot formed therein within which said common actuator extends and is thereby guided.

16. An arrangement according to claim 15, and a pilot-operated lock valve and pressure-compensated flow control valve disposed in flow control between each said table top function valve means and the associated said table top function cylinder.

17. An arrangement according to claim 1, and a pilot-operated lock valve and pressure-compensated flow control valve disposed in flow control between said table top function valve means and the associated said table top function cylinder.

18. An operating table comprising, a movable patient-supporting table top, a table top function hydraulic actuating cylinder for effecting table top function movements, a hydraulic cylinder for elevation of said table top, a pump and a reservoir, and a hydraulic control valve arrangement, said control valve arrangement comprising:

table top function valve means for selectively enabling and disabling fluid flow actuation connection to and from said table top function cylinder between said pump and said fluid reservoir, elevate valve means effecting, in one position thereof, fluid flow actuation connection to and from said elevate cylinder between said pump and said reservoir, and effecting in said same one position overriding fluid flow actuation disconnection in the connection between said pump, said table top function cylinder and reservoir.

19. An arrangement according to claim 18, said elevate valve means, in said one position thereof, effecting overriding fluid flow pressure disconnection from said table top function cylinder.

20. An arrangement according to claim 18, further comprising:

a plurality of table top function cylinders, said elevate valve means in said one position thereof, effecting overriding fluid flow pressure disconnection from said table top function cylinder, individual table top function valve means for enabling and disabling fluid flow action connection to and from respectve ones of a plurality of said table top function cylinders, a fluid supply pressure manifold in common port connection to each of said table top function control valve means, said elevate valve means in said one position effecting pressure disconnection from said pump to said common fluid pressure manifold and pressure connection to said elevate cylinder, and in a second position effecting fluid disconnection from said pump to said common fluid pressure manifold and disconnection of fluid pressure from said pump to said elevate cylinder.

21. An arrangement according to claim 20, further comprising:

a common actuator for separately actuating selected ones of said individual table top function valve means, and a separate actuator for actuating said elevate valve means.

22. An arrangement according to claim 21, each of said table top function and elevate valve means comprising:

a slidable valve spool, and a common valve block having parallel spool-receiving bores for slidable movement of said valve spools therein and having interconnecting ports therein which in conjunction with said valve spools enable said spools to effect said fluid flow connections and disconnections.

23. An arrangement according to claim 22, said table top function valve spools and parallel bores therefor being positioned side-by-side along an arcuate imaginary line, said common actuator being a swingably pivoted lever having a universal pivot axis lying generally at the center of the radius of curvature of said arc, said common actuator being a manual lever selectively movably engagable with and disengagable from said table top function valve spools.

24. An arrangement according to claim 23, and a guide gate guiding movement of said common actuator lever, said guide gate having guide means preventing shift disconnection of said common actuator lever from a said table top function spool at other than the neutral "off" position thereof.

25. An arrangement according to claim 24, said guide gate having a multiple-H-slot guide slot formed therein within which said common actuator extends and is thereby guided.

26. An arrangement according to claim 25, and a pilot-operated lock valve and pressure-compensated flow control valve disposed in flow control between each said table top function valve means and the associated said table top function cylinder.

27. An arrangement according to claim 18, and separate actuators for actuating said table top function valve means and said elevate valve means.

28. An arrangement according to claim 27, each of said table top function and elevate valve means comprising:

a slidable valve spool, and a common valve block having parallel spool-receiving bores for slidable movement of said valve spools therein and having interconnecting ports therein which in conjunction with said valve spools enable said spools to effect said fluid flow connections and disconnections.

29. An arrangement according to claim 27, each of said table top function valve means comprising:

a slidable valve spool, and a common valve block having parallel spool-receiving bores for slidable movement of said valve spools therein and having interconnecting ports therein which in conjunction with said valve spools enable said spools to effect said fluid flow connections and disconnections.

30. An arrangement according to claim 29, said table top function valve spools and parallel bores therefor being positioned side by side along an arcuate imaginary line, said common actuator being a swingably pivoted lever having a universal pivot axis lying generally at the center of the radius of curvature of said arc, said common actuator being a manual lever selectively movably engagable with and disengagable from said table top function valve spools.

31. An arrangement according to claim 30, and a guide gate guiding movement of said common actuator lever, said guide gate having guide means preventing shift disconnection of said common actuator lever from a said table top function spool at other than the neutral "off" position thereof.

32. An arrangement according to claim 31, said guide gate having a multiple-H-slot guide slot formed therein within which said common actuator extends and is thereby guided.

33. An arrangement according to claim 32, and a pilot-operated lock valve and pressure-compensated flow control valve disposed in flow control between each said table top function valve means and the associated said table top function cylinder.

34. An arrangement according to claim 18, and a pilot-operated lock valve and pressure-compensated flow control valve disposed in flow control between said table top function valve means and the associated said table top function cylinder.

* * * * *